US009138800B2

(12) United States Patent
Harrison et al.

(10) Patent No.: US 9,138,800 B2
(45) Date of Patent: Sep. 22, 2015

(54) SAFETY WIRE PLIER

(75) Inventors: Barry J. Harrison, Davisburg, MI (US); Terrence D. Kalley, Troy, MI (US); John Burke, New Baltimore, MI (US); Daniel W. Brass, Berea, OH (US); Ronald Fred Johnson, Metamore, MI (US)

(73) Assignee: BRIGHT SOLUTIONS INTERNATIONAL LLC, Troy, MI (US)

( * ) Notice: Subject to any disclaimer, the term of this patent is extended or adjusted under 35 U.S.C. 154(b) by 511 days.

(21) Appl. No.: 13/389,731

(22) PCT Filed: Aug. 10, 2010

(86) PCT No.: PCT/US2010/002200

§ 371 (c)(1), (2), (4) Date: Apr. 12, 2012

(87) PCT Pub. No.: WO2011/019380

PCT Pub. Date: Feb. 17, 2011

(65) Prior Publication Data

US 2012/0186688 A1 Jul. 26, 2012

Related U.S. Application Data

(60) Provisional application No. 61/232,764, filed on Aug. 10, 2009, provisional application No. 61/246,343, filed on Sep. 28, 2009, provisional application No. 61/348,152, filed on May 25, 2010.

(51) Int. Cl.
*B21F 15/04* (2006.01)
*B21F 1/00* (2006.01)

(Continued)

(52) U.S. Cl.
CPC ..... *B21F 15/04* (2013.01); *B21F 1/002* (2013.01); *B25B 7/12* (2013.01); *B25F 1/00* (2013.01)

(58) Field of Classification Search
CPC ..... B21F 15/04; B21F 7/00; B21F 15/00; B21F 9/00; B21F 15/06; B21F 9/02; B21F 3/00; B21F 1/004; B21F 1/002; B25C 7/12; B25C 5/02; B25B 7/12; B25B 7/00; B25B 7/14; B25B 7/16; B25B 7/18; B25B 7/20; B25B 7/22; B21D 43/26; B21D 19/00; B21D 37/14; B25F 1/00
USPC ..... 140/93.6, 118, 121, 149, 127, 119, 49; 81/300, 415, 177.2, 180.1, 318, 319, 81/320, 321, 322, 323, 324, 332; 72/409.01–409.13, 409, 12, 409.14, 72/409.15, 409.16, 409.17, 409.18, 409.19
See application file for complete search history.

(56) References Cited

U.S. PATENT DOCUMENTS 168,360 A * 10/1875 Wiard ..... 81/131
874,394 A * 12/1907 Cork et al. ..... 7/134

(Continued)

OTHER PUBLICATIONS

International Search Report and Written Opinion of the International Searching Authority dated Oct. 5, 2010 for PCT/ US2010/002200.

(Continued)

*Primary Examiner* — Debra Sullivan
(74) *Attorney, Agent, or Firm* — Steptoe & Johnson LLP

(57) ABSTRACT

A safety wire plier includes a pair of plier arms with each of the arms including a jaw end and a handle. The plier arms of the safety wire plier are pivotally connected to each other for movement in either an open or closed position. The safety wire plier also includes a sealed lock for releasably locking the safety wire plier in the closed position.

14 Claims, 19 Drawing Sheets

(51) Int. Cl.
*B25B 7/12* (2006.01)
*B25F 1/00* (2006.01)

(56) References Cited

U.S. PATENT DOCUMENTS 1,388,398 A * 8/1921 Adams ..... 7/107
1,469,711 A * 10/1923 Bauwens ..... 140/118
2,079,505 A * 5/1937 Hopkins ..... 81/332
2,394,807 A * 2/1946 Robinson ..... 7/130
2,502,873 A * 4/1950 Miltner ..... 72/409.03
2,725,902 A 12/1955 Giuliano
2,737,983 A * 3/1956 Pray ..... 140/118
3,092,152 A * 6/1963 Neff ..... 140/119
3,502,112 A * 3/1970 Hankila ..... 138/99
3,990,138 A * 11/1976 Bellia ..... 29/235
4,665,953 A * 5/1987 Randall ..... 140/118
4,842,025 A * 6/1989 Box et al. ..... 140/119
5,004,020 A * 4/1991 Meinershagen ..... 140/93.6
5,211,209 A * 5/1993 Geibel et al. ..... 140/118
5,560,402 A * 10/1996 Bates ..... 140/118
5,669,425 A * 9/1997 Verlato ..... 140/119
6,792,835 B1 * 9/2004 Quick et al. ..... 81/177.2

OTHER PUBLICATIONS

International Preliminary Report on Patentability dated Feb. 23, 2012 for PCT/US2010/002200.

* cited by examiner

Cross Section of
Locking Mechanism

A - A

B - B

C - C

D - D

SAFETY WIRE PLIER

CLAIM OF PRIORITY

This application claims priority under 35 USC 371 to International Application No. PCT/US2010/02200, filed on Aug. 10, 2010, which claims priority to U.S. Provisional Application Ser. No. 61/232,764, filed Aug. 10, 2009, which claims priority to U.S. Provisional Application Ser. No. 61/246,343, filed Sep. 28, 2009, which claims priority to U.S. Provisional Application Ser. No. 61/348,152, filed May 25, 2010, each of which is incorporated by reference in its entirety.

TECHNICAL FIELD

This invention relates to safety wire plier for fastening specialized wires. More specifically, the invention relates to a safety wire plier with a secure locking mechanism.

BACKGROUND

Safety wire, also commonly known as lockwire, is used in the aerospace, auto-racing and manufacturing industries as an extra precaution to keep the vital fasteners in an airplane, helicopter, race car and/or a component of machinery from unintentionally becoming loose. In addition to these applications, safety wire is often used to secure fasteners on any machine or a machine component that is regularly subjected to a substantial amount of vibration that can potentially endanger users and/or bystanders, if the component were to become loose. For example, when servicing an aircraft, technicians are careful not to create what is known as foreign object damage (FOD) to the aircraft. It is critical not to leave any loose mechanical components in a jet engine or on the flight tarmac that may be drawn into engines, thereby creating a potential for a catastrophic disaster. FOD issues can be an important cause of concern for technicians performing maintenance on sensitive mechanical components. In the event of a FOD incident, the technicians must take apart the jet engine or crawl around on the tarmac and retrieve all parts before the aircraft can be cleared to fly.

SUMMARY

A plier can include a sealed lock mechanism. In one aspect, a plier can include a pair of first and second plier arms, each of the pair of plier arms including a jaw end and a handle, and the first and second plier arms pivotally connected to each other for movement in one of an open position and a closed position, a wire twister connected to a first plier arm, a sealed lock connected to the wire twister, and a connection portion fixed to the wire twister and connecting the first plier arm and the sealed lock. A plier can be a safety wire plier.

In some embodiments, a sealed lock can include a lock ring rod, lock ring rod guide with an orifice, and a slider connected to a first end of the lock ring rod, where the lock ring rod is housed within the lock ring rod guide for movement. A sealed lock can further include a lock ring, wherein the lock ring is connected to a first end of the lock ring rod.

In some embodiments, the sealed lock can further include a compression spring placed around the lock ring rod and housed within the orifice of the lock ring rod guide. In one aspect, the lock ring rod can be an integral rod with two diameters with a first diameter smaller than a second diameter, and the compression spring can be placed around the lock ring rod with the first diameter.

In some embodiments, the sealed lock can face the second plier arm, and the slider can surround an outer surface area of the twist mechanism. The slider slides along an axis which can be perpendicular to a cross section of the twisting mechanism.

In some embodiments, the second plier arm can include a detent for releasably securing the lock ring while locking the plier in the closed position. In some embodiments, the slider can slide upward towards the jaw end of the first and second plier arms and the compression spring can be compressed when the plier is locked in the closed position. In some circumstances, the slider can slide downward towards the handle of the first and second plier arms and the compression spring can be decompressed when the plier is placed in the open position.

In some embodiments, the second plier arm can include a hole for engaging the lock ring rod while locking the safety wire plier in the closed position. In some embodiments, the slider can slide downwards toward the handle of the first and second plier arms and the compression spring can be compressed when the plier is placed in the closed position. In some circumstances, the slider can slide upward towards the jaw end of the first and second plier arms and the compression spring can be decompressed when the safety wire plier is placed in the open position.

In some embodiments, the lock ring and the slider can be connected to the lock ring rod by welding. In some embodiments, the lock ring guide can be spot-welded into the twist mechanism.

In some embodiments, the lock ring rod can include an attachment component and the slider can include an attachment component, such that the attachment component of the lock ring rod and the attachment component of the slider can interact to conjoin the lock ring rod and the slider.

In some embodiments, the wire twister can be a reversible mechanism which can be capable of twisting the safety wire in both a clockwise and counter-clockwise directions. In other embodiments, the wire twister can be a mechanism which can twist the safety wire in only a clockwise or only a counter-clockwise direction.

In some embodiments, the lock ring rod can include a groove and the lock ring rod guide can include a lock ring rod guide pin that can be inserted into the lock ring rod guide perpendicular to the lock ring rod and can engage the groove of the lock ring rod.

In some embodiments, the jaw end can be a first jaw end and the plier can further include a second jaw end. In some circumstances, each of the first jaw end and second jaw end can have a cutting portion, and the cutting portion of the first jaw end can be sharp to cut thin objects and the cutting portion of the second jaw end can be less sharp to cut thicker objects.

In some embodiments, the slider can comprise a contact region. The contact region can include a central section between two wings. The wings can be at an angle relative to the central section. The angle can be between 10 to 40 degrees. The central section can be textured. In some embodiments, the contact region can encircle at least a portion of the wire twister.

In another aspect, a lock of a plier with a pair of plier arms with each of the pair of plier arms can include a jaw end and a handle. In some embodiments, the lock can include a lock ring rod, a lock ring rod guide with an orifice and a slider connected to a first end of the lock ring rod, where the lock ring rod can be housed within the lock ring rod guide for movement, and where the pair of plier arms can be pivotally connected to each other for movement in one of an open position and a closed position.

In some embodiments, the lock can further include a lock ring which releasably secures the lock to a detent, wherein the lock ring can connect to a second end of the lock ring.

In some embodiments, the lock can be attached to a wire twister and a first plier arm with a connection portion.

In some embodiments, the lock can further comprise a compression spring placed around the lock ring rod and housed within the orifice of the lock ring rod guide. In some embodiments, the lock ring rod can be an integral rod with two diameters with a first diameter smaller than a second diameter, and the compression spring can be placed around the lock ring rod with the first diameter.

In some embodiments, the locking mechanism can face a second plier arm with the detent, and the slider can surround an outer surface area of the wire twister.

In some embodiments, the slider can slide along an axis which is perpendicular to a cross section of the wire twister. In some embodiments, the slider can slide upward towards the jaw end of the first and second plier arms and the compression spring can be compressed when the safety wire plier is placed in the closed position. In some circumstances, the slider can slide downward towards the handle of the first and second plier arms and the compression spring can be decompressed when the safety wire plier is placed in the open position.

In some embodiments, the lock ring, lock ring rod and the slider can be connected through welding.

In some embodiments, the lock ring rod can include an attachment component and the slider can include an attachment component, such that the lock ring rod attachment component and the slider attachment component can interact to conjoin the lock ring rod and the slider.

In some embodiments, the lock ring guide can be spot-welded into the wire twister.

In some embodiments, the wire twister can be a reversible mechanism which can be capable of twisting the safety wire in both a clockwise and counter-clockwise direction. In other embodiments, the wire twister can be a mechanism which can twist the safety wire in only a clockwise or only a counter-clockwise direction.

In some embodiments, the lock ring rod can include a groove and the lock ring rod guide can include a lock ring rod guide pin that can be inserted into the lock ring rod guide perpendicular to the lock ring rod and can engage the groove of the lock ring rod.

In some embodiments, the slider can comprise a contact region. The contact region can include a central section between two wings. The wings can be at an angle relative to the central section. The angle can be between 10 to 40 degrees. The central section can be textured. In some embodiments, the contact region can encircle at least a portion of the wire twister.

In another aspect, a sealed lock can be connected to a wire twister of a safety wire plier, the sealed lock can include a lock ring, a lock ring rod with a first end connected to the lock ring, a slider connected to a second end of the lock ring rod, a lock ring rod guide with an orifice housing the lock ring rod and a compression spring, where the slider can slide upward towards a jaw end of the safety wire plier and the compression spring can be compressed when the safety wire plier is placed in a closed position.

In another aspect, a sealed lock can be connected to a wire twister of a safety wire plier, the sealed lock can include a lock ring, a lock ring rod with a first end connected to the lock ring, a slider connected to a second end of the lock ring rod, a lock ring rod guide with an orifice housing the lock ring rod and a compression spring, where the lock ring rod guide can encapsulate the lock ring rod and the compression spring and can prevent the lock ring rod and the compression spring from dislodging from the lock ring rod guide in the event of a mechanical failure.

In another aspect, a sealed lock can be connected to a wire twister of a safety wire plier, the sealed lock can include a lock ring, a lock ring rod with a first end connected to the lock ring, a slider connected to a second end of the lock ring rod, a lock ring rod guide with an orifice housing the lock ring rod and a compression spring, where the lock ring rod guide can encapsulate the lock ring rod and the compression spring and can keep out foreign debris from entering the sealed lock.

In another aspect, a method can include using a safety wire plier with a sealed lock connected to a wire twister. The method can include applying pressure on handles of the safety wire plier initially in an open position to a closed position, and engaging the wire twister and twisting the safety wire, where the sealed lock can include a lock ring, a lock ring rod with a first end connected to the lock ring, a slider connected to a second end of the lock ring rod, and a lock ring rod guide with an orifice housing the lock ring rod and a compression spring.

In some embodiments, the slider can slide upward towards a jaw end of the safety wire plier and the compression spring can be compressed when the safety wire plier is placed in the closed position.

In some embodiments, the lock ring rod guide can encapsulate the lock ring rod and the compression spring and can prevent the lock ring rod and the compression spring from dislodging from the lock ring rod guide in the event of a mechanical failure.

In some embodiments, the lock ring rod guide can encapsulate the lock ring rod and the compression spring and can keep out foreign debris from entering the sealed lock.

In another aspect, a plier can include a sealed lock attached to a wire twister, a first jaw end, and a second jaw end, where each jaw end can include a cutting portion, and the cutting portion of the first jaw end can be sharp to cut thin objects and the cutting portion of the second jaw end can be less sharp to cut thicker objects.

The details of one or more embodiments are set forth in the accompanying drawings and the description below. Other features, objects, and advantages of the invention will be apparent from the description and drawings, and from the claims.

DETAILED DESCRIPTION

Figure 1:
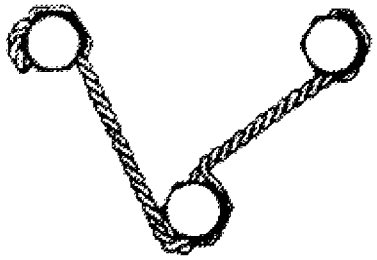
FIG. 1 depicts a safety wire tied around bolt fasteners.

Fasteners or bolts can be secured through safety wires tied between two bolt heads. Safety wire can be made of a malleable alloy such as stainless steel, and it retains its shape after being bent and keeps fasteners such as bolts used in vital components of an aircraft secured. These safety wires can be fastened by twisting the safety wires with safety wire plier. The safety wire can be looped between two or more specially prepared fasteners, and the heads of the fasteners can be drilled through the side perpendicular to the length of the fastener. For example, FIG. 1 depicts such safety wire tied around bolt fasteners.

In order to secure the safety wire to fasteners, a user can feed the wire through one fastener, loop it back upon itself and twist the safety wire using a safety wire plier. The safety wire can then be pulled through another fastener and the process can be repeated. If more than two fasteners are used, the safety wire can be reversed between the second and third fasteners to ensure that the safety wire stays tight. The safety wire can be installed in a manner that creates tension in the direction opposite of the fastener's removal.

The safety wire can be removable to allow for the service of the safety wire equipped machinery or component. Removal of the wire can require the inclusion of a wire cutting edge on a safety wire plier. Further, a safety wire plier can be reversible and be able to twist either in a clockwise or counterclockwise direction to allow for the securing of multiple fasteners with a single strand of wire. This can ensure that the second and subsequent fasteners can be held tight with the safety wire pulling in a direction opposite the direction from which the fasteners are removed. Alternatively, a safety wire plier can turn in only one direction, e.g. clockwise or counterclockwise.

Various safety wire plier are described, for example, in U.S. Pat. No. 4,665,953, U.S. Pat. No. 5,211,209, and U.S. Pat. No. 5,560,402, each of which is incorporated by reference in its entirety. For example, a reversible safety wire plier can include a conventional "yankee driver mechanism" as a shank to make the reversible motion possible. A switching gear mechanism can be used to change directions of the motion, and a switching gear mechanism can work by moving the driver axially and the plier can include a locking mechanism, where a user can squeeze the plier handles to a closed position, the plier handles can automatically lock in the closed position, and then can require user intervention to allow for the re-opening of the plier handles. Other reversible wire twisting pliers can differ in the design and operation of the actuating switch and can differ in the method of locking, while including a driver mechanism that can be axially movable to change direction. Other features can include a driver mechanism that can include a slide member, e.g. a barrel shaped annular member, slidably mounted on the outer surface of the collar and axially movable thereon, in which the locking mechanism can be latched in order for the plier to be locked. Other pliers can include a reversing mechanism that can be rotatably movable. Still other pliers can facilitate either single direction rotation (rotating only in either clockwise or anti-clockwise direction) or can be switched through a switch mechanism to rotate in either direction, making them reversible. See, for example, reversible products sold by Milbar Corporation (Stride Tool) and Stahlwille. The Stride product complies with the ASME Std. B107.18-2003, which is an industry standard.

However, disadvantages can be associated with these conventional locking mechanisms, such as the locking mechanisms being susceptible to premature wear, the locking mechanism untimely opening the locked plier while fastening a safety wire, and the locking mechanism designs not fully housing all the small components of the locking mechanism, resulting in parts falling out of the locking mechanism due to wear and rough handling over time, which can cause a safety wire plier to unintentionally open while in use. In the event a safety wire plier breaks or fails, small components within the conventional locking mechanism can fall out and can create a FOD hazard.

Figure 2:
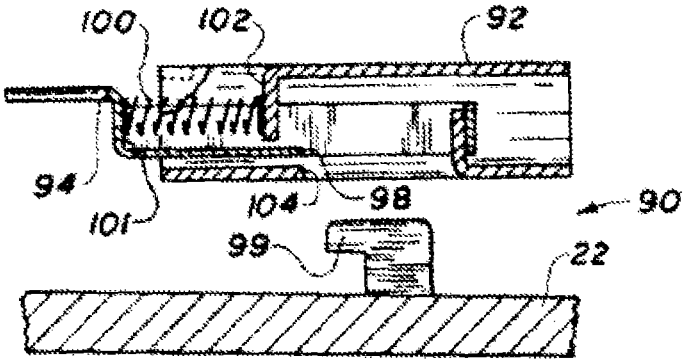
FIG. 2 CONVENTIONAL ART
FIG. 2 illustrates a conventional latch locking mechanism of safety wire plier in a position prior to locking.
Figure 3:
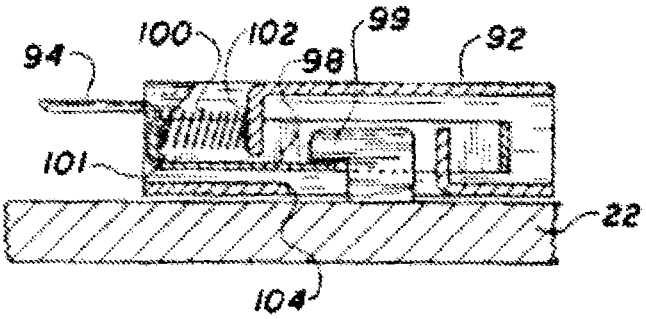
FIG. 3 CONVENTIONAL ART
FIG. 3 illustrates a conventional latch locking mechanism of safety wire plier in a position subsequent to locking.

Conventional safety wire pliers may not fully address and remove potential FOD issues. FIG. 2 and FIG. 3 illustrate a conventional latch locking mechanism 90 for locking safety wire plier. See, for example, U.S. Pat. No. 5,211,209, which is incorporated by reference in its entirety. FIG. 2 illustrates a latch locking mechanism prior to locking. The latch locking mechanism 90 can include a housing 92 formed on one side of a safety wire plier handle. The housing 92 can slidably mount a latch lever 94. The latch lever 94 can include a latch plate 98, which can engage a catch 99 formed on another side of a safety wire plier handle 22. A coil spring 100 can be positioned between the shoulder 101 on the latch lever 94 and a surface 102 of the housing 92. A slot 104 can be formed to receive the catch 99.

In a conventional safety wire plier, a safety wire plier can be put in a locking position by "pinching" the latch lever 94 between the catch 99 and the housing 92. Once the lock is engaged, as shown in FIG. 3, the force exerted by the handles of the plier can pull the latch lever 94 towards the housing 92 and can pinch the latch lever 94 between the catch 99 and housing 92.

The latch locking mechanism in conventional safety wire plier can be classified as a friction device with the whole mechanism dependent upon sufficient friction between the latch lever 94 and the catch 99 to prevent slippage from occurring. Once the friction is reduced through wear over time, the coil spring 100 can assert itself and can release the lock, thereby opening the handles of a safety wire plier while in use. Forces exerted upon the latch lever 94 and the catch 99 can constitute a point loading over a very small area. The thickness of the latch lever 94 can be such that the latch lever 94 can be susceptible to deformation, which can further reduce friction between the latch lever 94 and the catch 99. Deformation can also occur in the housing 92 at the point of loading. Any deformation or reduction in temper of a safety wire plier' handles can affect the operability of the latch locking mechanism to such a degree that even after what can be classified as normal use, the latch lock can fail to lock at all or open during use.

The open design of the conventional latch locking mechanism can also permit the build up of foreign matters and debris in the latch locking mechanism. This can restrict or reduce the movement of the latch lever 94 within the housing 92. This restriction of movement can also adversely affect operability of locking and can result in premature release of a safety wire plier when the tool is in use. These drawbacks can pose significant disadvantages for technicians seeking to avoid FOD incidents. In addition, FOD incidents can occur if small components within the latch locking mechanism fall out of the latch locking mechanism. For example, small components can dislodge if a safety wire plier suffers a harsh impact, such as falling to the ground from an aircraft.

Figure 4:
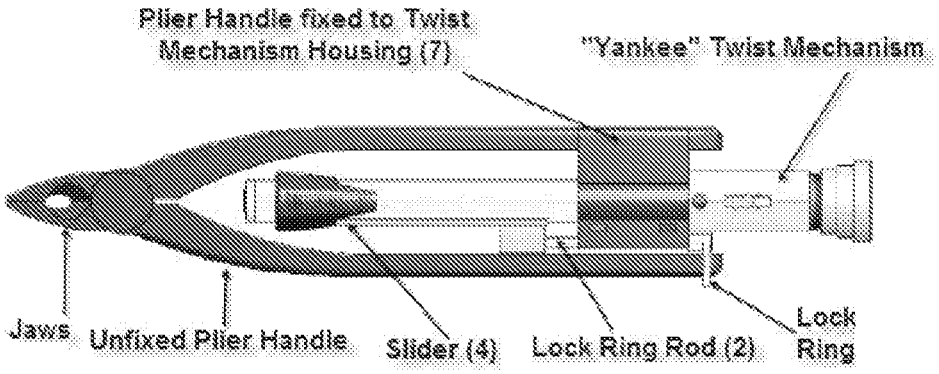
FIG. 4 illustrates a safety wire plier with the sealed lock mechanism.

One embodiment of a safety wire plier can include a fail-safe definitive sealed lock mechanism that does not open on its own even with wear and use over time. FIG. 4 illustrates a safety wire plier with the sealed lock mechanism. As shown in FIG. 4, a safety wire plier can include plier arms with handles and jaws, as known in the art. A safety wire plier can also incorporate a wire twister such as the reversible Yankee mechanism known in the art. One of ordinary skill in the art will understand that any number of known conventional wire twisting mechanisms may be utilized with a safety wire plier.

Figure 5:
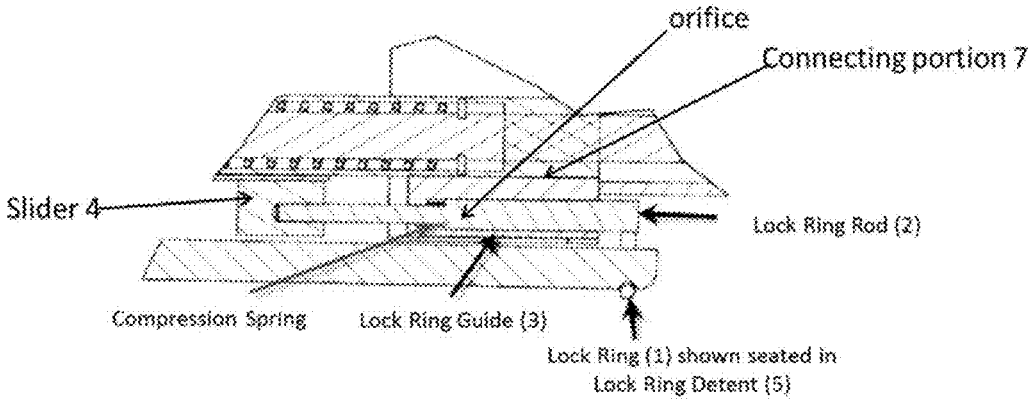
FIG. 5 illustrates a cross section of the sealed lock mechanism of a safety wire plier.

A safety wire plier can include a sealed lock mechanism with a lock ring 1, lock ring rod 2, lock ring rod guide 3 (for example, as shown in FIG. 5) and slider 4. The locking mechanism can be permanently connected to one side of a safety wire plier handle through a connecting portion 7. The connecting portion 7 can be affixed to one side of a safety wire plier handle and can also be affixed to the wire twister housing. Slider 4 can be connected to the lock ring rod guide 3, can surround an outer surface area of the twist mechanism housing, and can slide along an axis perpendicular to a cross section of the twist mechanism housing. The lock ring 1, lock ring rod 2, lock ring rod guide 3 and slider 4 can be made of steel or any equivalent material suitable for construction, and connected through various methods, such as through a welding process commonly known in the art. The lock ring rod guide 3 may be spot welded into the twist mechanism housing.

Figure 6:
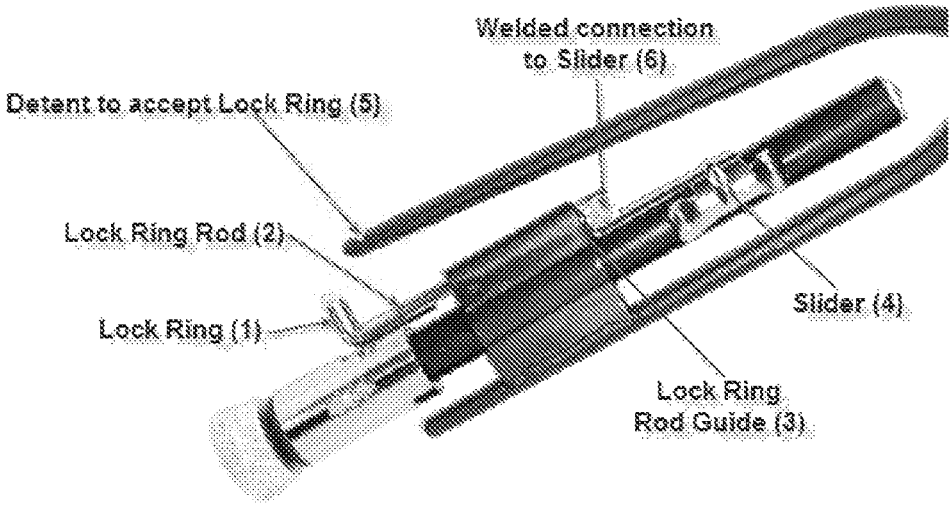
FIG. 6 illustrates a perspective view of the sealed lock mechanism of a safety wire plier in an open position.

Another handle of the wire safety plier, not permanently connected to the twist mechanism housing, can contain a detent 5 to accept the lock ring 1. FIG. 6 depicts a perspective view of a safety wire plier prior to locking. As shown in FIG. 6, a sealed lock mechanism can face the handle of the plier with the detent, which is the handle of the plier not permanently connected to the twist mechanism housing.

A safety wire plier with a sealed lock mechanism can provide a definitive lock rather than a friction lock as employed in conventional plier. A safety wire plier with a sealed lock mechanism can also remove any possibility of FOD incidents caused by a failure of the locking mechanism, and can incorporate an automatic release mechanism for ease of use.

Figure 7:
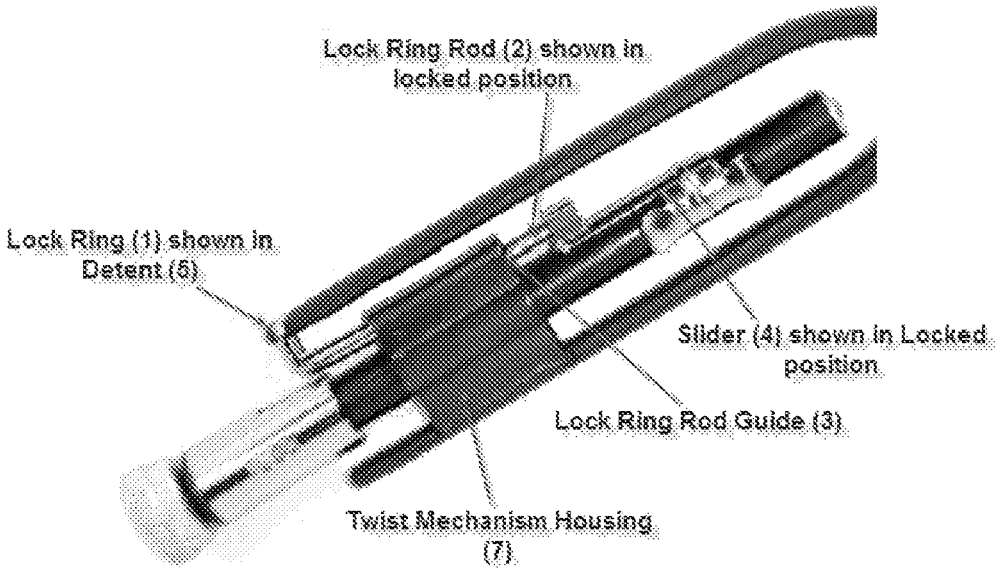
FIG. 7 illustrates a perspective view of the sealed lock mechanism of a safety wire plier in a locked position.

The sealed lock mechanism of a safety wire plier can operate differently from conventional plier. In latch locking mechanisms of conventional plier, the slider can be pulled downward towards a user operating the plier (e.g., towards direction of handles of the plier) when the plier can be placed in a locked position. In contrast, the sealed lock mechanism of a safety wire plier can have the slider 4 pushing upward away from a user operating the plier (e.g., towards direction of jaws of the plier) to place the plier in a locked position. This upward displacement of the slider 4 is depicted in FIG. 7. When a safety wire plier is placed in a locked position, the lock ring rod 2, which can be connected to the slider, can also be pushed upward.

FIG. 5 depicts a cross section of the sealed lock mechanism of a safety wire plier. As shown in FIG. 5, the lock ring rod can be of integral design with two diameters. The part of the lock ring rod with a smaller diameter can fit into the lock ring rod guide 3 with an orifice to accommodate a compression spring. The part of the lock ring rod with a larger diameter can encapsulate the compression spring within the orifice of the lock ring rod guide 3. When a user operating a safety wire plier compresses the handles of a safety wire plier, the slider 4 can be pushed upward towards the jaw of the plier and away from the user. This can result in the lock ring rod 2, which can be connected to the slider 4, also pushing upward into the lock ring rod guide 3. This can further result in the compression spring being compressed within the lock ring rod guide 3.

Once the lock ring 1 is in line with the compressed handle of a safety wire plier with the detent 5, lock ring 1 can be placed into the detent 5, as shown in FIGS. 5 and 7. Unlike other conventional pliers that can utilize a friction locking mechanism, additional pressure to a safety wire plier's handles can be required to unseat the lock ring 1 from the detent 5 in safety wire plier with the sealed lock mechanism.

Once additional pressure is applied to a safety wire plier's handles, the lock ring 1 can release clear of the detent 5. When the lock ring 1 clears the top of the detent 5, the compression spring located within the locking ring rod guide 3 can decompress and release the lock ring rod 2 and lock ring 1 downward, thereby causing the lock mechanism to release.

In some embodiments, the handle of a safety wire plier may not include a detent 5. The lock ring 1 can be placed over the compressed handle of a safety wire plier, and then the user can release the handle, which can catch in the lock ring 1 and hold the handle in a compressed position.

A safety wire plier with the sealed lock mechanism can be advantageous over conventional plier with a friction type of locking mechanism. Once the lock ring 1 is seated in the detent 5 on a safety wire plier's handle, it can require effort on the part of the user to release the lock ring 1 from its seat. Further, a safety wire plier with the sealed lock mechanism can contain small components that can be completely sealed and encapsulated within the lock ring rod guide 3. The lock ring 1 and the slider 4 can be permanently fixed to the lock ring rod 2 so that unless there is substantial damage to a safety wire plier, the compression spring cannot fall out of the lock ring rod guide 3.

Safety wire plier can also be used as a cutter for safety wire, coil, or other thin objects. However, conventional safety wire plier cannot normally cut thick metal strips or wires, such as cotter pins. A cotter pin, like safety wire, can be used in the aerospace, auto-racing and manufacturing industries to secure nuts to the ends of round shafts, such as axles and clevis pins. A cotter pin can also be known as a split pin. A cotter pin can be made of a thick metal wire, thicker than safety wire. It can be desirable that a safety wire plier can cut both thin wires (e.g. safety wire) and thicker wires (e.g. cotter pin). For example, when servicing an aircraft, technicians may want to carry as few tools as possible. However, different cutters can be required for wire of different dimensions. For example, when attempting to cut thicker wire, a less sharp cutter may be more suitable, which can shear the wire essentially by weakening it and separating it more than actually cutting it. Sharper cutters can be good for cutting thin wire; however, they may either not cut thicker wire at all or at best cut it poorly, while raising the risk that damage will occur to the sharp edges of such cutters due to the thickness and strength of the wire attempting to be cut. Conversely, if one tries to cut thin wire using a less sharp cutting edge, it may tend to crush and deform the wire instead of actually cutting it.

Figure 8:
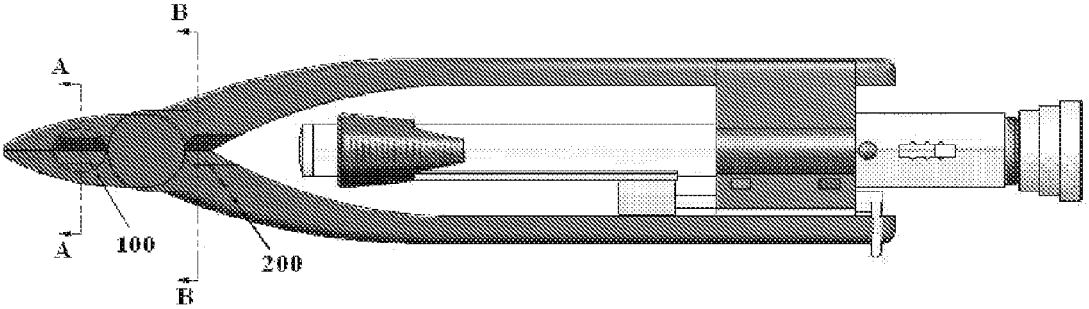
FIG. 8 illustrates a safety wire plier with two cutting portions and the sealed lock mechanism.
Figure 8A:
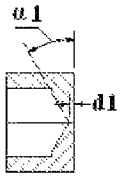
FIG. 8A illustrates the cross section of the first cutting portion of a safety wire plier shown in FIG. 8.
Figure 8B:
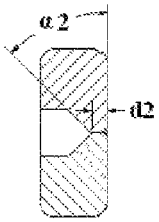
FIG. 8B illustrates the cross section of the second cutting portion of a safety wire plier shown in FIG. 8.

Some embodiments of a safety wire plier can include two cutting portions, which can make it possible to cut both thin wires and thicker wires. FIG. 8 illustrates a safety wire plier with two cutting portions and the sealed lock mechanism. FIGS. 8A and 8B illustrate the cross section of two cutting portions in different sizes. The sharper cutting portion in A-A has a smaller width $d_1$ and angle $\alpha_1$ of the cutting edge, compared to the width $d_2$ and angle $\alpha_2$ of the cutting portion in B-B. A safety wire plier can have two cutting edges to cut both fine wires and coarser, stronger objects such as cotter pins. The cutting portion edges can include hardened metal.

As shown in FIG. 8, a safety wire plier can include plier arms with handles and jaws, as known in the art. A safety wire plier can also incorporate a wire twister, such as the reversible Yankee mechanism known in the art. A safety wire plier can includes two jaws (100 and 200). In other embodiments, the jaws can be combined sequentially in the front of the head of the plier or in the rear of the head. A safety wire plier can include a sealed lock mechanism, for example, as shown in FIG. 5.

Figure 9:
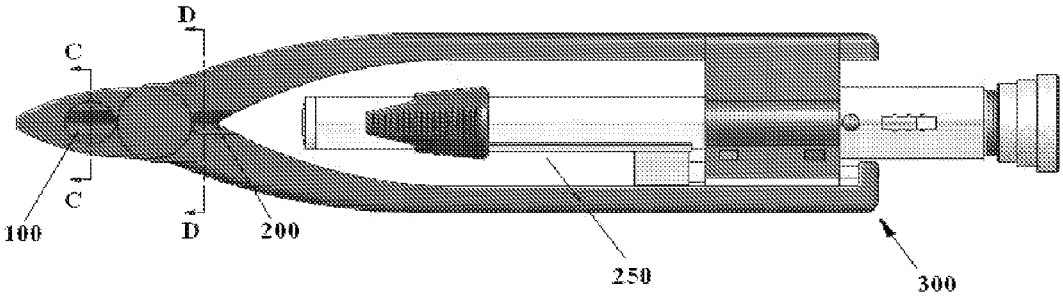
FIG. 9 illustrates a safety wire plier with two cutting portions and the sealed lock mechanism.
Figure 9A:
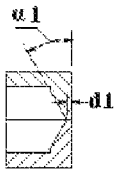
FIG. 9A illustrates the cross section of the first cutting portion of a safety wire plier shown in FIG. 9.
Figure 9B:
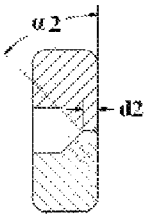
FIG. 9B illustrates the cross section of the second cutting portion of a safety wire plier shown in FIG. 9.

FIG. 9 illustrates a safety wire plier with two cutting portions and a different sealed lock mechanism, e.g. a pin lock mechanism. FIGS. 9A and 9B illustrate the cross section of two cutting portions. The sharper cutting portion in C-C can have a smaller width $d_1$ and angle $\alpha_1$ of the cutting edge, compared to the width $d_2$ and angle $\alpha_2$ of the cutting portion in D-D.

As shown in FIG. 9, a safety wire plier can include a different sealed lock mechanism. The sealed lock 300 can include a lock ring rod, a lock ring rod guide with an orifice, and a slider connected to a first end of the lock ring rod, wherein the lock ring rod can be housed within the lock ring rod guide for movement.

Figure 10:
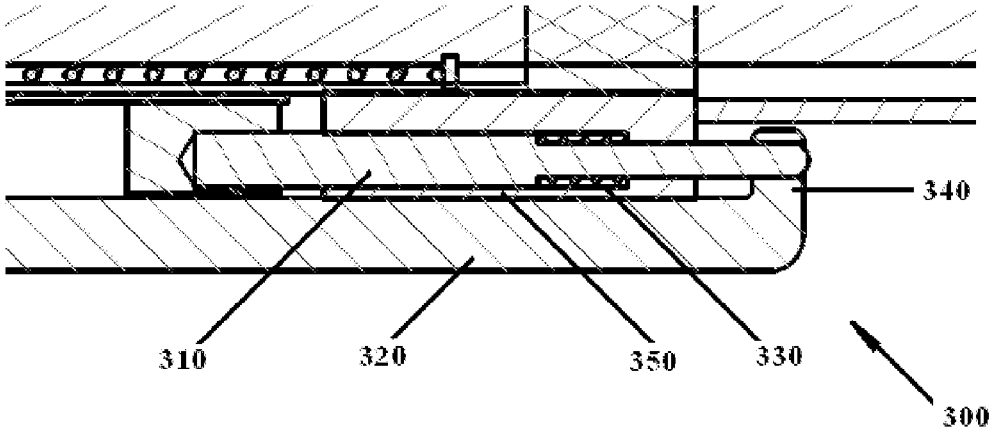
FIG. 10 illustrates a cross section of the sealed lock mechanism of a safety wire plier.

FIGS. 9 and 10 illustrate a pin lock. A safety wire plier can include a sealed lock mechanism with a lock ring rod 310, lock ring rod guide 350, a handle with an L-shaped end 300 and slider (not shown) (FIG. 10). In addition, a sealed lock mechanism can include a compression spring 330. A handle of a plier can include an L-shaped end 300 opposite the jaws of the plier. The L-shaped end can include a hole, which can receive the lock ring rod. The end of lock ring rod 310 entering the hole can be round-shaped or angle-shaped so as to facilitate entry into lock ring member 340.

As shown in FIG. 10, lock ring rod 310 can be of integral design with two diameters. The part of lock ring rod 310 with a smaller diameter can fit into lock ring rod guide 350 with an orifice to accommodate compression spring 330. The part of lock ring rod 310 with a larger diameter can encapsulate compression spring 330 within the orifice of lock ring rod guide 350. When a user operating a safety wire plier compresses the handles of a safety wire plier, the slider (see, e.g., 250 in FIG. 9) can be pushed downward away from the jaws of the plier and towards the user. This can result in lock ring rod 310 connected to the slider (see, e.g., 250 in FIG. 9) also pushing downward into the lock ring rod guide 350. This can further result in the compression spring 330 being compressed within lock ring rod guide 350. Once lock ring member 340 at the end of compressed handle 320 of a safety wire plier is in line with lock ring rod 310, lock ring rod 310 can be inserted into lock ring member 340, as shown in FIGS. 9 and 10. Unlike other conventional pliers that utilize a friction locking mechanism, additional pressure to a safety wire plier's handles can be required to unload lock ring rod 310 from lock ring member 340 in safety wire plier with the sealed lock mechanism.

In other embodiments, lock ring member 340 can project from the inner surface of the handle much closer to the jaw and away from the end of the handle. Lock ring rod 310 can slide towards the jaw and away from the handle to lock into lock ring member 340, in which case the sealed lock 300 can be configured to face the jaw rather than facing the end of the handle.

Figure 11:
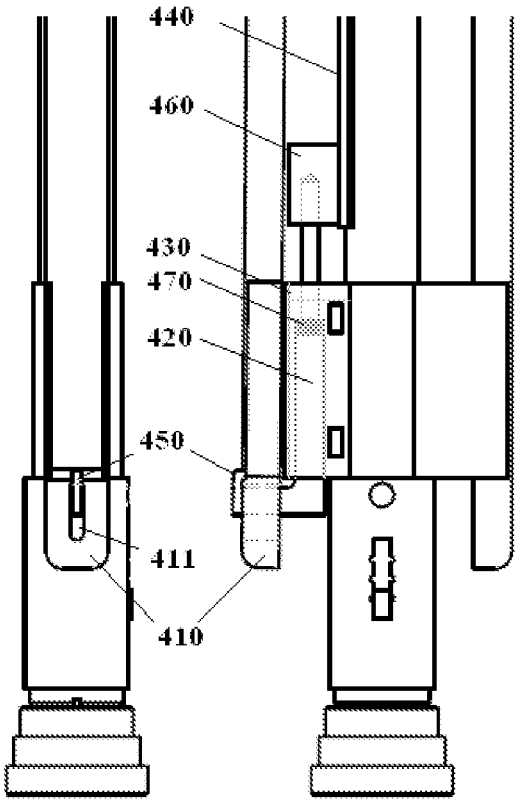
FIG. 11 illustrates a side and top view of the sealed lock mechanism of a safety wire plier in a locked position.

FIG. 11 depicts a side and top view of a sealed lock mechanism of a safety wire plier. As shown in FIG. 11, lock ring rod 420 can be of integral design with two diameters. The part of the lock ring rod with a smaller diameter can fit into the lock ring rod guide 430 with an orifice to accommodate compression spring 470. The part of lock ring rod 420 with a larger diameter can encapsulate compression spring 470 within the orifice of lock ring rod guide 430. When a user operating a safety wire plier compresses the handles of a safety wire plier, the slider 440 can be pushed upward towards the jaw of the plier and away from the user. This can result in lock ring rod 420 connected to the slider 440 by welded connection 460 also pushing upward into lock ring rod guide 430. This can further result in compression spring 470 being compressed within lock ring rod guide 430 by one end of lock ring rod 420. The other end of lock ring rod 420 can be connected to locking member 450.

Handle end 410 can include opening 411. Once the handles of safety wire plier are fully compressed, locking member 450 can be placed and releasably secured into opening 411, as shown in FIG. 11. Unlike other conventional pliers that utilize a friction locking mechanism, additional pressure to a safety wire plier's handles can be required to unseat the locking member 450 from opening 411 in safety wire plier with the sealed lock mechanism.

Figure 12:
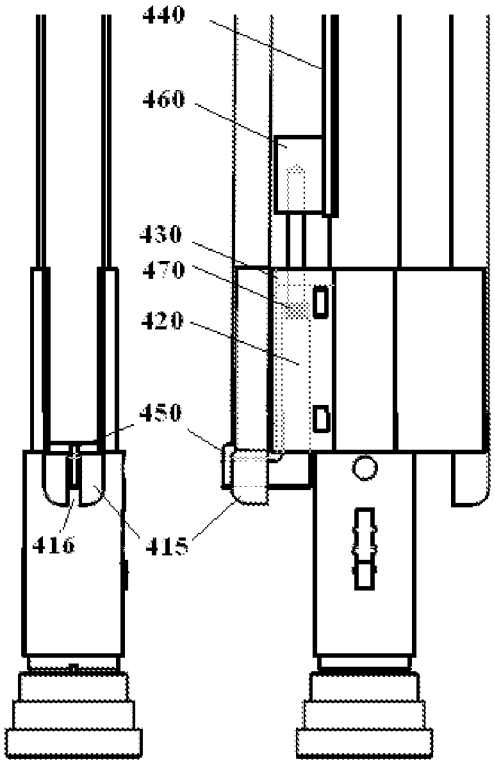
FIG. 12 illustrates a side and top view of the sealed lock mechanism of a safety wire plier in a locked position.

FIG. 12 depicts a side and top view of a sealed lock mechanism of a safety wire plier. The plier can have a lock mechanism similar to the mechanism shown in FIG. 11. However, the plier can have a smaller handle end 415. Handle end 415 can include lock gap 416. Similarly, once the handles of safety wire plier are fully compressed, locking member 450 can be placed and releasably secured into gap 416, as shown in FIG. 12. Additional pressure to a safety wire plier's handles can be required to unseat the locking member 450 from gap 416 in safety wire plier with the sealed lock mechanism.

Opening 411 and gap 416 can be machined into the handle of the plier arm. The edges of opening 411 and gap 416 can be chamfered to lead locking member 450 into opening 411 and gap 416. Similarly, the end of locking member 450 entering opening 411 or gap 416 can be round-shaped or angle-shaped so as to facilitate entry into opening 411 or gap 416.

Figure 13:
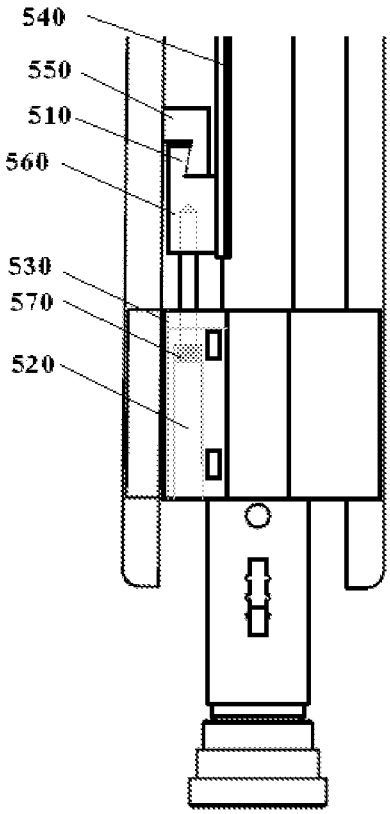
FIG. 13 illustrates a side view of the sealed lock mechanism of a safety wire plier in a locked position.

FIG. 13 depicts a side view of a sealed lock mechanism of a safety wire plier. As shown in FIG. 13, lock ring rod 520 can be of integral design with two diameters. The part of the lock ring rod with a smaller diameter can fit into the lock ring rod guide 530 with an orifice to accommodate compression spring 570. The part of lock ring rod 520 with a larger diameter can encapsulate compression spring 570 within the orifice of lock ring rod guide 530. Lock ring rod 520 can be connected to slider 540 by welded connection 560. The handle can have a first locking member 550 projecting from the inner surface of the handle. Second lock member 510 can be connected to an upper end of welded connection 560, opposite to first locking member 550. The slider 540 can be pushed upward towards the jaw of the plier and away from the user. For a ring lock mechanism, this can result in lock ring rod 520 also pushing upward into lock ring rod guide 530 and compression spring 570 being compressed within lock ring rod guide 530. This can further result in first locking member 550 moving toward to second locking member 510. For a pin lock, this can result in the lock ring rod also pushing upward and disengaging from the detent in a handle of the plier. Disengaging the lock ring rod from the detent can result in release of the handles from the compressed position.

In some embodiments, once the handles of a safety wire plier are fully compressed, as shown in FIG. 13, first locking member 550 can be locked with second locking member 510. Additional pressure to a safety wire plier's handles can be necessary to unlock first locking member 550 from second locking member 510 in safety wire plier with the sealed lock mechanism.

Figure 14:
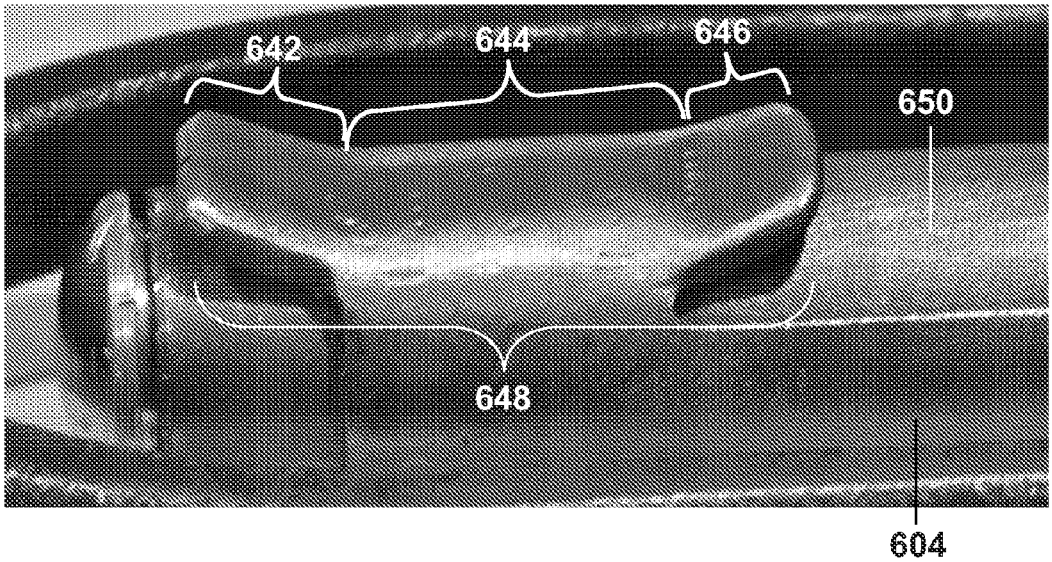
FIG. 14 is a side view of a contact region of a slider.

Referring to FIG. 14, the slider can have a contact region 648. The contact region 648 can be integral to the slider 604 and can be configured such that it is only on one side of the twist mechanism housing 650. The contact region 648 can include a central section 644 and two wings 642, 646. The central section 644 can be between the two wings 642, 646. The central section 644 can be closer to the axis of the twist mechanism housing 650 than the wings 642, 646. The central section 644 can be flat so that it is essentially in one plane or the central section 644 can be convex. The central section 644 can include a depression, valley or a trough. The central section 644 can have a texture; for example, it can include at least one ridge (for example, see FIGS. 17*a*, 17*b*, 18*a* and 18*b*), indentation, opening, bump or any other suitable texture that can increase friction when the user of the pliers presses against the central section 644. The central section 644 can also be smooth or solid.

The wings 642, 646 can be at an angle relative to the central section 644. The angle of the wings 642, 646 relative to the central section 644 can vary from 0 to 90 degrees, or 10 to 40 degrees; for example, the angle can be 30 degrees. The wings 642, 646 can be coplanar with the central section 644 or perpendicular to the axis of the twist mechanism housing 650. The wings 642, 646 can be convex, concave or flat. The wings can include walls. The wings 642, 646 can angle out away from the plier and then curve down towards the plier at the ends of the wings 642, 646. The wings 642, 646 can also be smooth or have a texture. Textures, for example, can be ridges, indentations, openings, bumps or any other suitable texture that can increase friction when the user of the plier presses against the central section 644.

Figure 15:
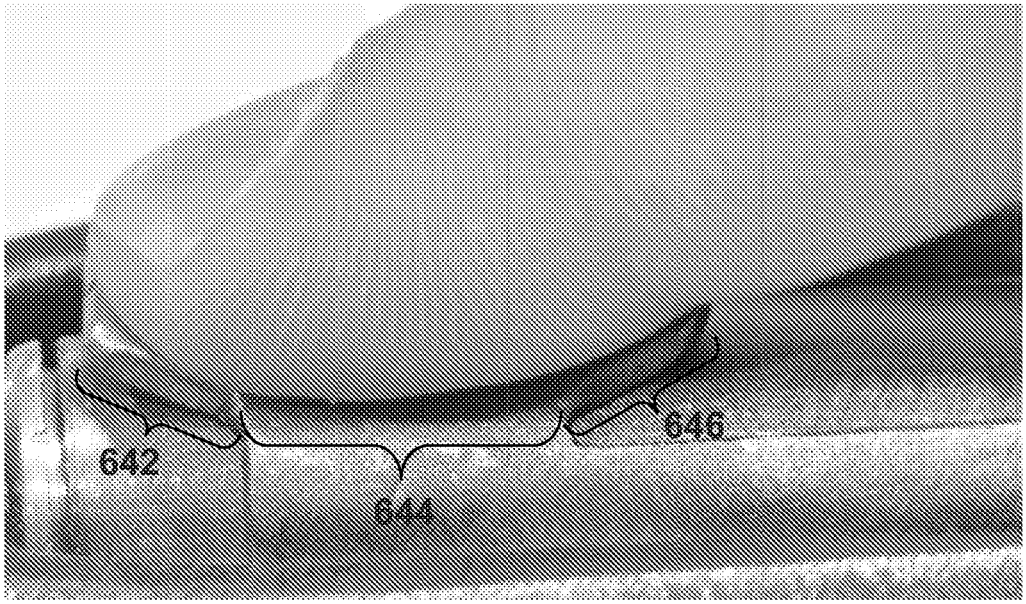
FIG. 15 is a side view of a contact region of a slider being utilized.
Figure 16:
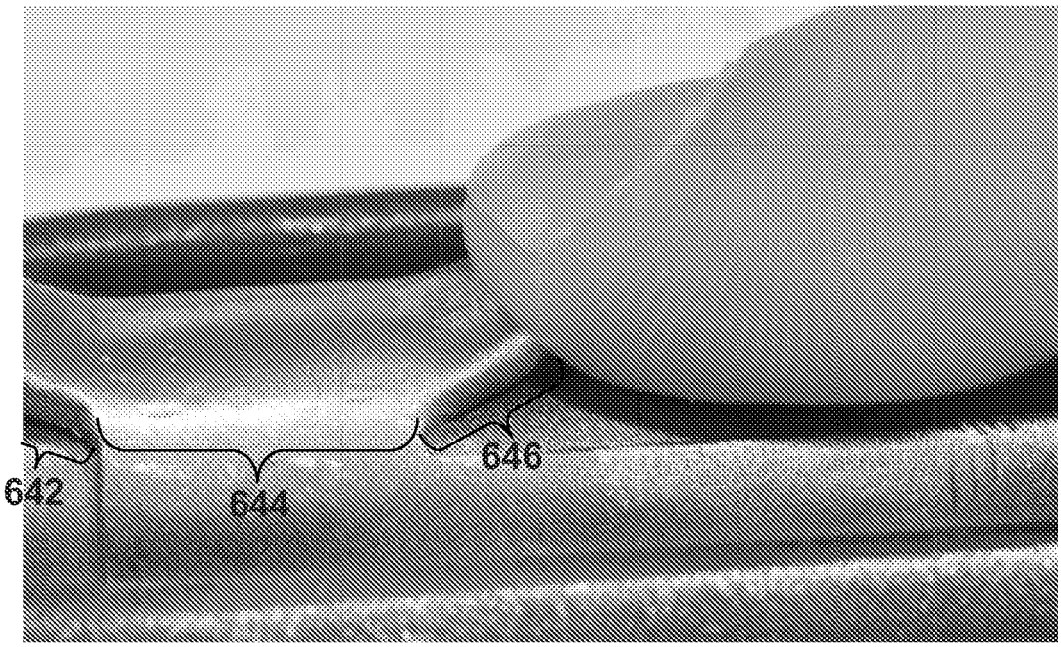
FIG. 16 is a side view of a contact region of a slider being utilized.

The contact region 648 can be oriented such that one wing 642 is closer to the jaws of the plier and the other wing 646 is closer to the handles of the plier. The slider can be pushed upward away from a user operating the plier (e.g., towards direction of jaws of the plier) to place the plier in a locked position. To apply pressure upward, the user can either place his finger in the central section 644 and push upward against wing 642 (FIG. 15) or place his finger below the wing 646 and push upward against wing 646 (FIG. 16). Conversely, the slider can be pushed downward towards a user operating the plier (e.g., towards direction of handles of the plier) to release the plier from a locked position. To apply pressure downward, the user can either place his finger in the central section 644 and push downward against wing 644 (FIG. 15) or place his finger above the wing 642 and push downward against wing 642 (not shown). Being able to press against either wing 642 or 646 can be advantageous because this dual option makes it easier for use by users with both small and large hands. Additionally, in tight situations the user can have a choice of where to apply pressure when locking the tool. Due to the slider being able to be used in both directions, the slider can be used both for locking and unlocking the tool, depending on the design of the locking mechanism.

Figure 17A:
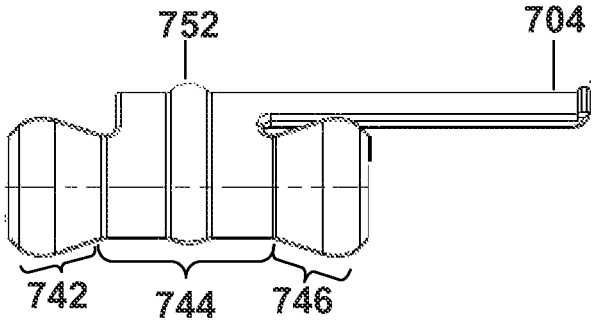
FIGS. 17*a* and 17*b* illustrate perspective views of the slider.
Figure 17B:
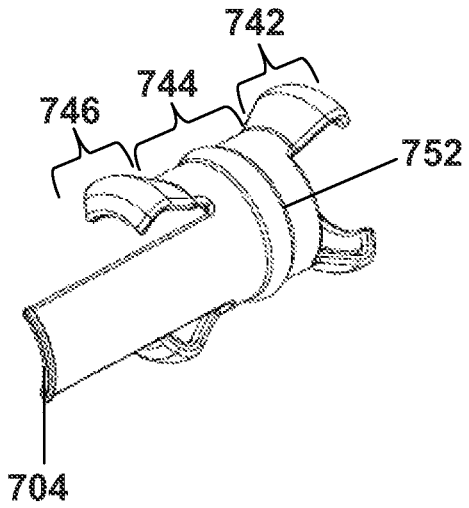
Figure 18A:
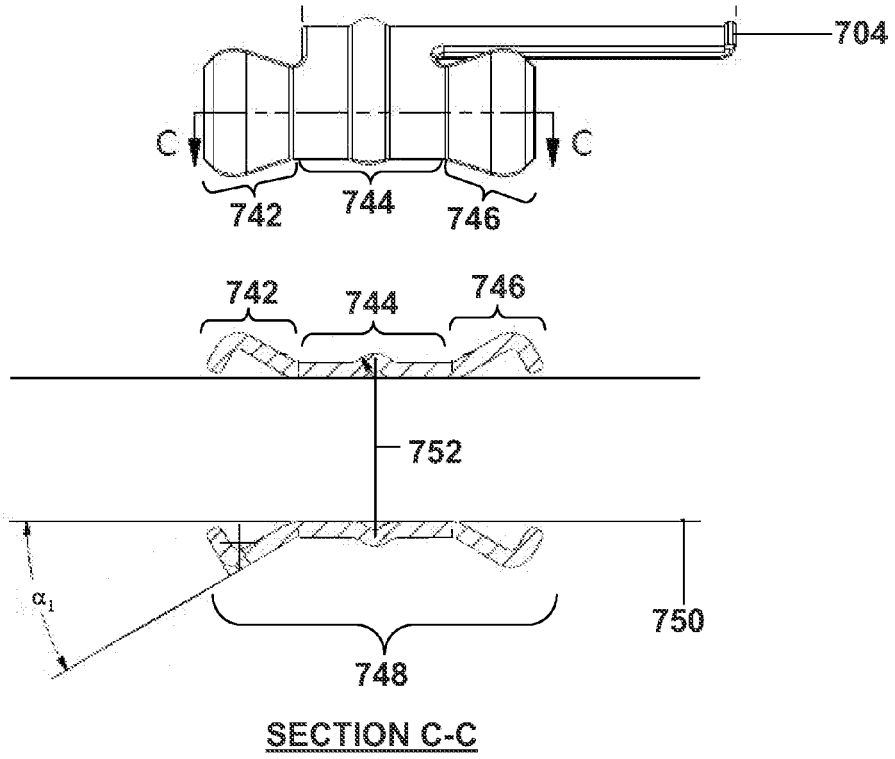
FIGS. 18*a* and 18*b* illustrate perspective views of the slider with angles.
Figure 18B:
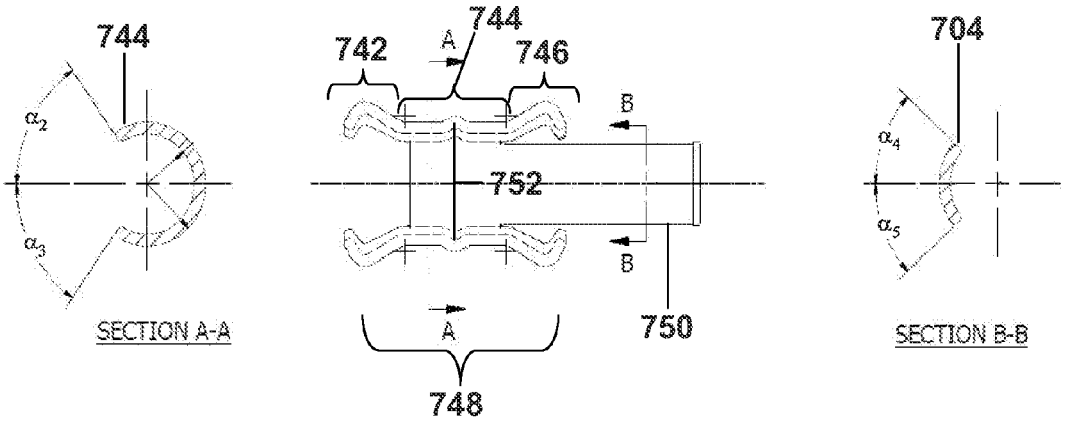

Referring to FIGS. 17*a*, 17*b*, 18*a* and 18*b*, the contact region 748 can be integral to the slider 704 (FIGS. 17*b* and 18*b*). The contact region 748 can also be added to the slider. The contact region 748 can encircle a portion of the twist mechanism housing 750 (FIGS. 17*a*, 17*b*, 18*a* and 18*b*). The portion of the twist mechanism housing that is encircled by the contact region 748 can be represented by angles $\alpha_2$ and $\alpha_3$ (FIG. 18*b*). Angles $\alpha_2$ and $\alpha_3$ can be between 0 degrees and 90 degrees; for example, angles can be 45, 50, 55, or 60 degrees. The portion of the twist mechanism housing that is encircled by the slider 704 can be represented by angles $\alpha_4$ and $\alpha_5$ (FIG. 18*b*). Angles $\alpha_4$ and $\alpha_5$ can be between 0 degrees and 90 degrees; for example, angles can be between 30 and 60 degrees, specifically 43 degrees.

The contact region 748 can include a central section 744 and two wings 742, 746. The central section 744 can be between the two wings 742, 746, and the central section 744 can be closer to the axis of the twist mechanism housing 750 than the wings 742, 746 (FIG. 18*b*). The central section 744 can be flat so that it is essentially in one plane or the central section 744 can be convex. The central section 644 can include a depression, valley or a trough. The central section 744 can have a texture; for example, it can include at least one ridge, indentation, opening, bump or any other suitable texture that can increase friction when the user of a plier presses against the central section 644. The central section 644 can also be smooth or solid. As shown in FIGS. 17*a* and 17*b*, the central section 744 can have one ridge 752 that wraps around the central section 744. The ridge 752 can be located in the center of the central section or it can be closer to wing 742 or wing 746. The texture of the central section 744 can be integral to the central section 744 or added to central section 744.

The wings 742, 746 can be at an angle $\alpha_1$ relative to the central section 744 (FIG. 18*a*). The angle $\alpha_1$ of the wings 742, 746 relative to the plane of the central section 744 can vary from 0 to 90 degrees; for example, the angle $\alpha_1$ can be 30 degrees. The wings 742, 746 can be coplanar with the central section 744 or perpendicular to the plane of the central section 744. The wings 742, 746 can be convex, concave or flat. The wings can include walls. The wings 742, 746 can angle out away from the plier and then curve down towards the plier at the ends of the wings 742, 746 (FIGS. 18*a* and 18*b*). The curve can be circular or angular. The curve can be smooth or it can come to a point. The wings 742, 746 can be smooth, as shown in FIGS. 17*a*, 17*b*, 18*a* and 18*b*, or have a texture. Textures, for example, can be ridges, indentations, openings, bumps or any other suitable texture that increases friction when the user of the plier presses against the wings 742, 746. The texture of the wings can be integral to the wings or added to the wings.

A slider can be connected to a lock ring rod that is part of a ring lock mechanism (see, for example, FIG. 7, FIGS. 20*a* and 20*b*) or a pin lock mechanism (see, for example, FIG. 10). The slider used with any mechanism can include a contact region and or wings. The slider, including the contact region, can be made out of metal, plastic, a composite or a combination of these materials.

Figure 19A:
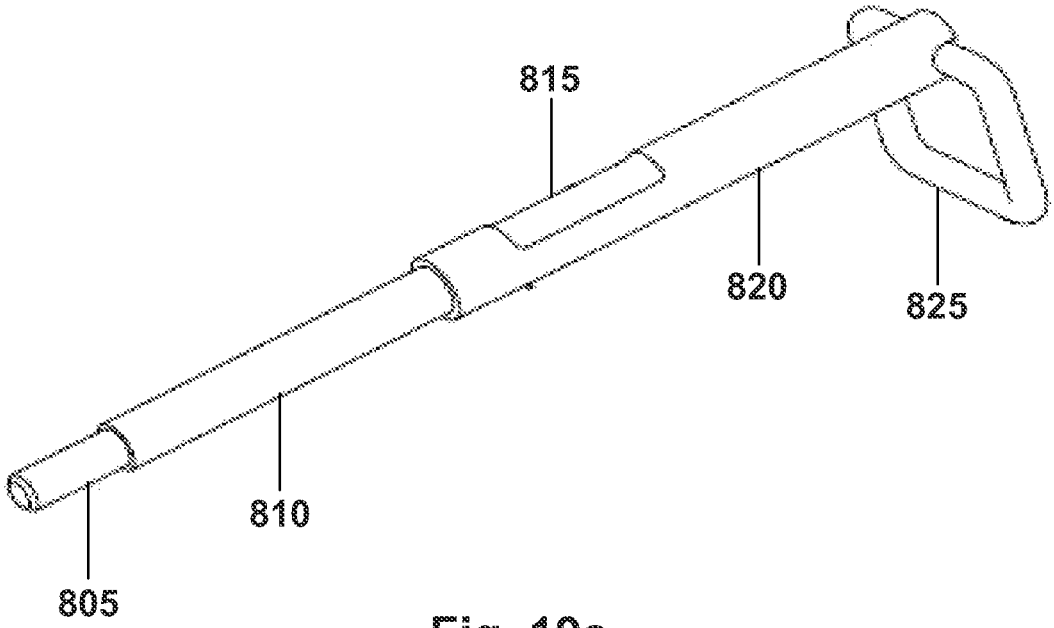
FIGS. 19*a* and 19*b* show perspective views of a lock ring rod and a slider.

Referring to FIG. 19*a*, a ring lock mechanism can include a lock ring rod 820 and a threaded nut 835. A lock ring rod 820 can include two or more sections. A first section can include a guide section 810, which can be inserted in a lock ring rod guide (shown as 920 in FIGS. 20*a* and 20*b*). The first section can also include an attachment component 805. The attachment component can be a portion of an attachment mechanism. For example, an attachment component can include a threaded section. The attachment component 805 can have a decreased diameter. A second section 820 can have a larger diameter than the first section. The second section 820 can include a groove 815. The groove 815 can include one or more of a trough, a slot, an indentation or a hole. At the end of the second section 820 opposite the first section 810 can be a ring lock 825. The ring lock 825 can have a detent (not shown) or it may not have a detent.

Figure 19B:
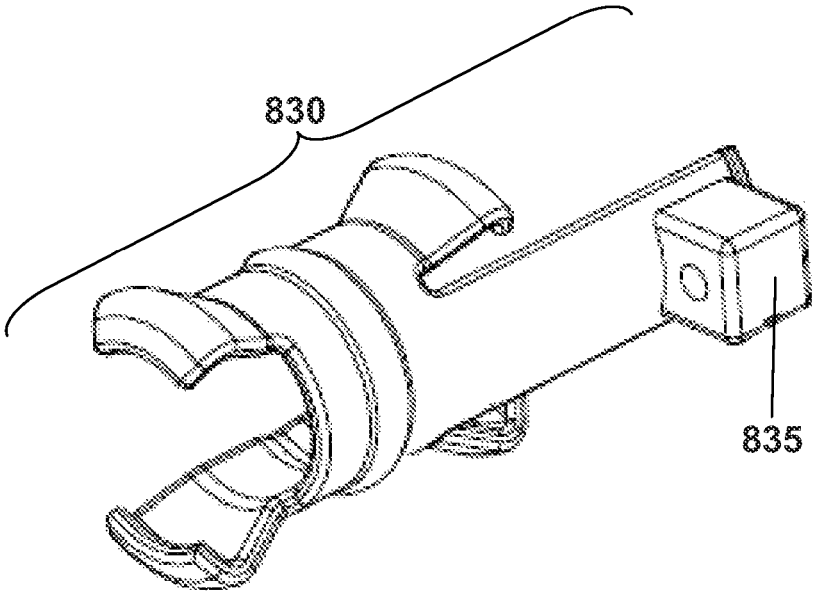

Referring to FIG. 19*b*, a slider 830 can have a slider attachment component 835. The attachment component can be a portion of an attachment mechanism. A slider attachment component can engage the lock ring rod attachment component to conjoin the slider and the lock ring rod. For example, the attachment component of the lock ring rod can include a male part and the attachment component of the slider can include a female, or vice versa. The attachment components can be held together by friction. The attachment components can be a locking mechanism, rotating mechanism, twisting mechanism, a combination of these mechanisms or any other suitable securing mechanism. For example, a locking mechanism can be two threaded portions configured to be screwed together. Another example of a locking mechanism can be a spring, such as a spring loaded lock, pin or plunger. A locking mechanism can also be a screw or lock nut. The attachment components can also be held physically together. For example, the attachment components can be regions on the lock ring rod and the slider where the lock ring rod and the slider are welded together.

In an exemplary embodiment, the lock ring rod can include a threaded section. The threaded section 805 can have a threaded surface that includes threading that is complementary to threading on a surface of a threaded nut 835 on a slider 830 (FIG. 19*b*). The slider 830 can have a contact region and wings, as described above. The threaded section 805 can be screwed into the threaded nut 835 and secured, conjoining the slider 830 and lock rod 802.

Figure 20A:
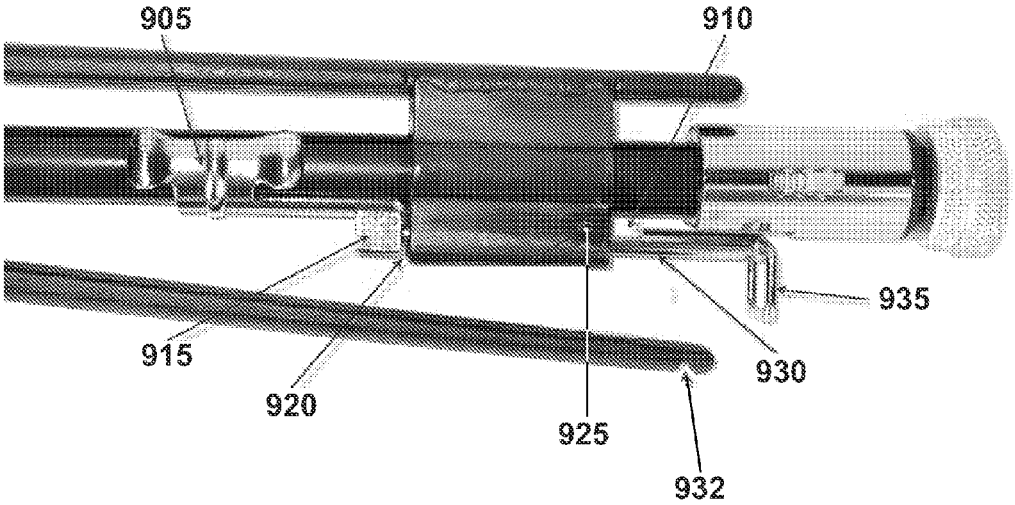
FIGS. 20*a* and 20*b* show perspective views of a plier with a lock ring mechanism in the open and closed positions.
Figure 20B:
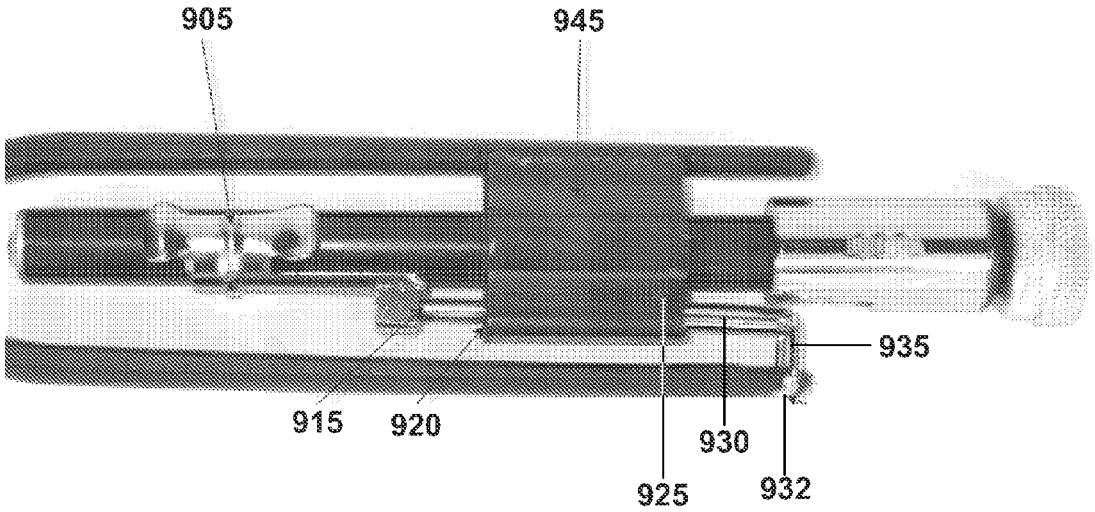

Referring to FIGS. 20*a* and 20*b*, a plier can include a ring lock mechanism (also shown in FIGS. 19 *a* and 19 *b*). The lock ring rod 930 can be inserted, attachment component in first, into a lock ring rod guide 920, entering at the end furthest from the jaws and exiting at the end closest to the jaws. The attachment component of the lock ring rod can then be attached to the attachment component of the slider 905, conjoining the slider 905 with the lock ring rod. The lock ring 935 can be located on the side of the lock ring rod guide opposite the threaded nut 915. Portions of the first section and second section of the lock ring rod 930 can be contained within the lock ring rod guide 920. A portion of the groove 910 in the second section can be contained within the lock ring rod guide 920. A lock ring rod guide pin 925 can be inserted into the lock ring rod guide 920 perpendicular to the lock ring rod 930. The lock ring rod guide pin 925 can engage the groove 910 in the second section of the lock ring rod 930. As the slider 905 is pushed down away from the jaws of the plier, the lock ring rod guide pin 925 can make contact with the edge of the groove 910 closest to the jaws, preventing the lock ring rod 930 from traversing farther away from the jaws. Conversely, as the slider 905 is pushed towards the jaws of the plier, the lock ring rod guide pin 925 can make contact with the edge of the groove 910 furthest from the jaws, preventing the lock ring rod 930 from traversing closer to the jaws. Because moving the slider 905 and lock ring rod 930 can move the lock ring 935, limiting the movement of the slider 905 and lock ring rod 930 can allow for optimal positioning of the lock ring 935. The lock ring rod guide pin 925 can also prevent the lock ring rod 930 from rotating within the lock ring rod guide 920. This can decrease wear on the components of the locking mechanism and can help to ensure the lock ring is in the proper position to engage the handle of the plier, easing the use of the plier for a user. Using a lock ring rod guide pin can also ensure that the lock ring rod cannot loosen or unscrew once the lock ring rod has been fitted.

During use, a user can compress the handles of a plier. Once compressed, the user can move the slider 905 towards the jaws of the plier. As the slider 905 moves towards the jaws of the plier, the lock ring rod 930 can also traverse through the sealed locking mechanism and bring the lock ring rod ring 935 towards the jaws of the plier. The lock ring rod ring 935 can slide over a handle of the plier. The handle can include a detent 932. The lock ring rod ring 935 can engage the detent 932 and hold the handles of the plier in a closed position (see FIG. 20*b*). Unlike other conventional pliers that utilize a friction locking mechanism, additional pressure to a safety wire plier's handles can be required to unload lock ring rod 310 from lock ring member 340 in safety wire plier with the sealed lock mechanism 945. Once unlocked, the slider 905 can be moved away from the jaws of the plier, which in turn will move the lock ring rod 930 away from the jaws of the plier through the locking mechanism 945 and move the lock ring rod ring 935 away from the jaws of the plier. After the lock ring rod ring 935 has been moved away from the jaws of the plier, the handles of the plier can be opened (see FIG. 20*a*).

To assemble one embodiment of the lock ring mechanism, the lock ring rod 930 can be inserted through the lock ring guide 920. The lock ring rod 930 can be screwed into the threaded nut 915 attached to the slider 905. Once the lock ring rod is secure, the lock ring rod guide groove can be aligned with a hole in the lock ring rod guide that accepts a lock ring rod guide pin. The lock ring rod guide pin 925 can then be inserted through the hole in the lock ring rod guide and engage the groove in the lock ring rod.

While the invention has been shown and explained in the embodiment described herein, it is to be understood that the invention should not be confined to the exact showing of the drawings, and that any variations, substitutions, and modifications are intended to be comprehended within the spirit of the invention. Other embodiments are within the claims.

What is claimed is:

1. A plier, comprising:

a pair of first and second plier arms with each of the pair of plier arms including a jaw end and a handle, and the first and second plier arms pivotally connected to each other for movement in one of an open position and a closed position;

a wire twister attached to the first plier arm;

a sealed lock attached to the wire twister, wherein the sealed lock comprises a lock ring;

a lock ring rod;

a lock ring rod guide with an orifice;

a slider connected to a first end of the lock ring rod, wherein the lock ring rod is housed within the lock ring rod guide for movement; and a connection portion fixed to the wire twister and connecting the first plier arm and the sealed lock;

wherein the second plier arm includes a detent for releasably securing the lock ring while placing the safety wire plier in the closed position.

2. The plier of claim 1, wherein the lock ring is connected to a first end of the lock ring rod.

3. The plier of claim 2, wherein the sealed lock further comprises a compression spring placed around the lock ring rod and the compression spring is housed within the orifice of the lock ring rod guide.

4. The plier of claim 1, wherein the lock ring rod is an integral rod with two diameters with a first diameter smaller than a second diameter, and the compression spring is placed around the lock ring rod with the first diameter.

5. The plier of claim 4, wherein the sealed lock faces the second plier arm, and the slider surrounds an outer surface area of the wire twister and the slider slides along an axis which is perpendicular to a cross section of the wire twister.

6. The plier of claim 3, wherein the slider slides upward towards the jaw end of the first and second plier arms and the compression spring is compressed when the safety wire plier is placed in the closed position.

7. The plier of claim 3, wherein the slider slides downward towards the handle of the first and second plier arms and the compression spring is compressed when the plier is placed in the closed position.

8. The plier of claim 1, wherein the lock ring rod includes an attachment component and the slider includes an attachment component, such that the attachment component of the lock ring rod and the attachment component of the slider interact to conjoin the lock ring rod and the slider.

9. The plier of claim 1, wherein the wire twister is a reversible mechanism which is capable of twisting the safety wire in both a clockwise and counter-clockwise direction.

10. The plier of claim 1, wherein the wire twister is a mechanism which twists the safety wire in only a clockwise or only a counter-clockwise direction.

11. The plier of claim 1, wherein the lock ring rod includes a groove and wherein the lock ring rod guide includes a lock ring rod guide pin that is inserted into the lock ring rod guide perpendicular to the lock ring rod and engages the groove of the lock ring rod.

12. The plier of claim 1, wherein the jaw end is a first jaw end including a first cutting portion and the plier further includes a second jaw end including a second cutting portion, and the first cutting portion is sharp to cut thin objects and the second cutting portion is less sharp to cut thicker objects.

13. The plier of claim 1, wherein the slider comprises a contact region.

14. A plier, comprising:

a pair of first and second plier arms with each of the pair of plier arms including a jaw end and a handle, and the first and second plier arms pivotally connected to each other for movement in one of an open position and a closed position;

a wire twister attached to the first plier arm;

a sealed lock attached to the wire twister, wherein the sealed lock comprises a lock ring;

a lock ring rod;

a lock ring rod guide with an orifice;

a slider connected to a first end of the lock ring rod, wherein the lock ring rod is housed within the lock ring rod guide for movement; and a connection portion fixed to the wire twister and connecting the first plier arm and the sealed lock, wherein the second plier arm releasably secures the lock ring while placing the safety wire plier in the closed position.

* * * * *